United States Patent [19]

Rader

[11] Patent Number: 4,700,945

[45] Date of Patent: Oct. 20, 1987

[54] EXERCISE APPARATUS

[76] Inventor: Delbert L. Rader, Gresham, Oreg.

[21] Appl. No.: 779,344

[22] Filed: Sep. 24, 1985

[51] Int. Cl.[4] ..... A63B 21/00

[52] U.S. Cl. ..... 272/127; 272/72; 272/120

[58] Field of Search ..... 272/93, 120, 124, 143, 272/902, 146, 72, 114, 126; 280/233

[56] References Cited

U.S. PATENT DOCUMENTS

| | | | |
|---|---|---|---|
| 1,368,716 | 2/1921 | Gontrum et al. . | |
| 2,733,922 | 2/1956 | Diego | 272/120 |
| 3,558,130 | 1/1971 | Anderson | 272/72 |
| 3,677,569 | 7/1972 | Larson . | |
| 3,809,393 | 5/1974 | Jones . | |
| 4,023,808 | 5/1977 | Hebert | 272/143 X |
| 4,374,519 | 2/1983 | Stauft . | |

FOREIGN PATENT DOCUMENTS

| | | | |
|---|---|---|---|
| 2917834 | 11/1980 | Fed. Rep. of Germany | 272/143 |
| 850610 | 9/1939 | France | 272/120 |
| 2305917 | 10/1976 | France | 272/902 |
| 2488514 | 2/1982 | France | 272/127 |
| 117960 | 10/1969 | Norway | 272/120 |

*Primary Examiner*—Richard J. Apley
*Assistant Examiner*—Robert W. Bahr
*Attorney, Agent, or Firm*—Henderson & Sturm

[57] ABSTRACT

A combined exercise apparatus (10) equally adapted for use in both the vertical and horizontal planes, wherein the apparatus comprises a wheeled unit (11), and an adjunct unit (12) wherein the adjunct unit (12) comprises a rigid element (14) and an elongated flexible element (13), whereby the adjunct unit (12) can be deployed in a variety of modes with respect to said wheeled unit (11).

3 Claims, 8 Drawing Figures

EXERCISE APPARATUS

TECHNICAL FIELD

The present invention relates generally to the area of user controlled rollable exercise equipment.

BACKGROUND OF THE INVENTION

While wheeled exercise platforms are by no means a recent innovation in the exercise equipment area of technology, their usage to date has been virtually restricted to horizontal or only slightly inclined surfaces, as is adequately represented in U.S. Pat. No. 3,809,393.

The basic principle employed in devices of this type is the moveable support of a portion of the users body along a generally horizontal plane, whereby the user is assisted in extending and retracting their torso in a generally horizontal plane.

As a result of the foregoing situation, most of the prior art devices have been concerned solely with the toning or development of the users upper torso, and as a consequence have failed to recognize that the basic structure can be slightly modified by the addition of a separate structural element that may be optionally associated with the basic structure, and/or a portion of the users body to vastly expand the utilitarian aspects of the wheeled platform per se.

SUMMARY OF THE INVENTION

Briefly stated, the present invention involves the recognition of the fact that the usage of a wheeled exercise platform did not necessarily have to be restricted to a generally horizontal plane; and, in fact would serve as an excellent mechanism for exercising both the upper and/or lower torso of a user depending on the particular method of use.

This invention also considered the limitations inherent in a wheeled exercise platform per se; and, by the addition of a relatively simple adjunct structure vastly expanded the utilitarian functions of the basic platform structure.

In summary this invention broadly contemplates the deployment of a wheeled platform in both a vertical plane and a horizontal plane, both alone and in combination with an adjunct structure that comprises a rigid element and a flexible element.

BRIEF DESCRIPTION OF THE DRAWINGS

These and other objects, advantages, and novel features of the invention will become apparent form the detailed description of the best mode for carrying our the preferred embodiment of this invention, particularly when considered in conjunction with the accompanying drawings wherein.

BEST MODE FOR CARRYING OUT THE INVENTION

Figure 1:
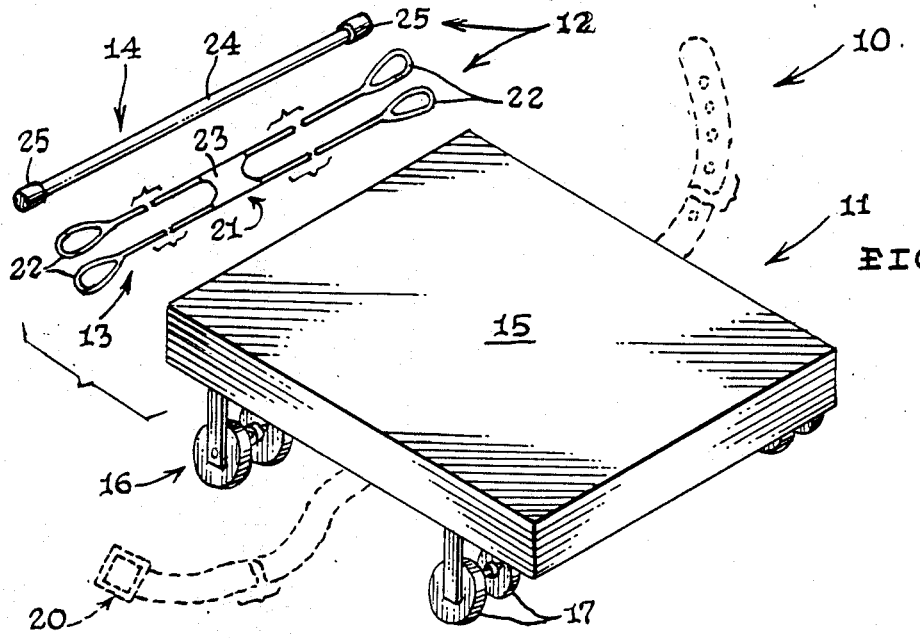
FIG. 1 is a perspective view of the combined apparatus of the present invention.

As can best be seen by reference to FIG. 1 the combined apparatus that forms the basis of the invention is designated generally by the reference numeral (10). The combined apparatus (10) comprises in general a wheeled platform unit (11) and an adjunct unit (12) wherein the adjunct unit (12) comprises a flexible element (13) and a rigid element (14). These units will now be described in seriation fashion.

Figure 2:
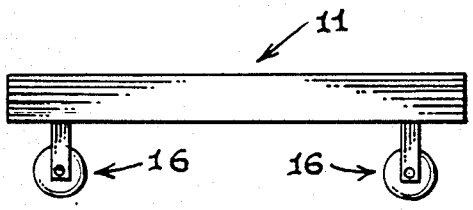
FIG. 2 is a side elevation view of the wheeled platform unit.
Figure 3:
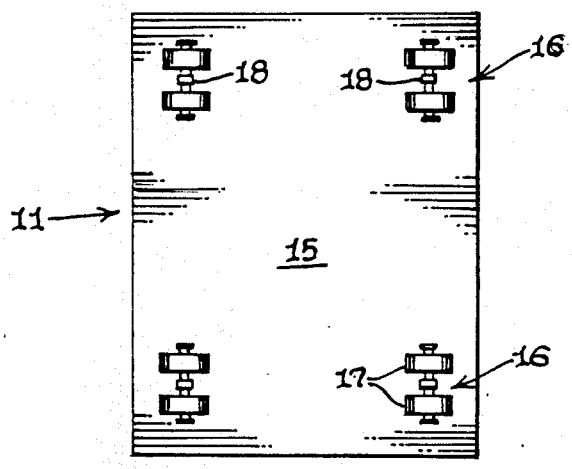
FIG. 3 is a bottom elevation view of the wheeled platform unit.

As shown in FIGS. 1 thru 3 the wheeled unit (11) comprises in general an elongated generally rectangular padded platform member (15) provided with a plurality of downwardly depending wheeled elements (16) proximate the corners of the platform member (15). Each of the wheeled elements (16) further comprise a tandem wheel assembly wherein each of the wheels (17) of the assembly are fabricated from low friction non-scratching material such as hard plastic, teflon, or the like.

As can best be seen by reference to FIG. 3, the axles (18) of the wheeled elements (16) are disposed parallel to the long dimension of the elongated rectangular platform member (15) whereby the direction of travel of the wheeled platform is perpendicular to the long dimension of the wheeled unit (11). The purpose of this particular dimensioning being that when the wheeled unit (11) is deployed in the vertical plane as illustrated in FIG. 4, the long dimension of the wheeled unit (11) provides a greater surface area support surface for the users back.

Figure 4:
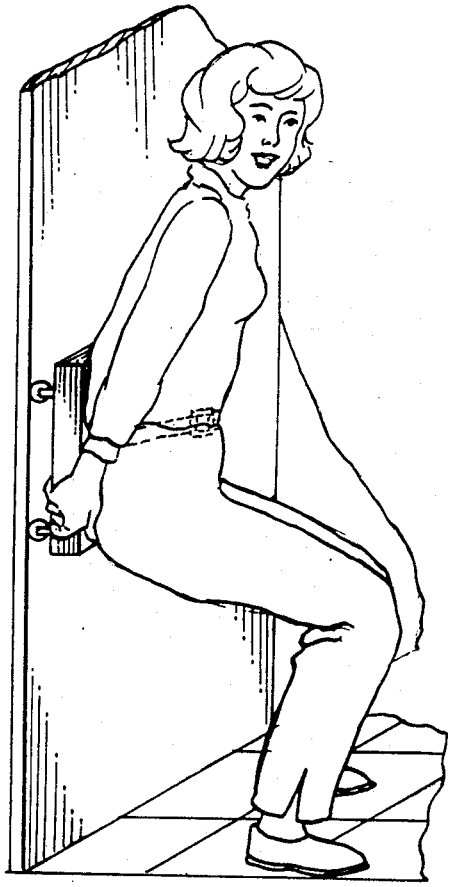
FIG. 4 is a perspective view of one proposed deployment of the wheeled platform.

It should also be appreciated by reference to FIG. 4, that when the wheeled unit (11) is deployed in the vertical plane, it provides an excellent means for exercising the users lower torso and particularly the users calves and thigh muscles. Along those same lines, to facilitate the use of the wheeled unit (11) in the vertical plane; this invention also contemplates the provision of releasable securing means (20), shown in phantom in FIG. 1, for retaining the wheeled unit (11) proximate the users lower back during vertical plane exercises.

As can best be seen by reference to FIG. 1, the adjunct unit (12) comprises a flexible element (13) and a rigid element (14). The flexible element (13) comprises an elongated bifurcated double handled strap member (21) wherein each end of the strap member (21) is provided with a pair of handle loops (22), and the mid-section of the strap member (21) is provided with an intermediate connecting portion (23) that operatively joins the respective ends of the strap member (21) together.

The rigid element (14) of the adjunct unit (12) comprises an elongated rigid bar member (24) having enlarged cylindrical caps (25) formed on its opposite ends. The enlarged cylindrical caps (25) act as spacer elements for the elongated bar member (24) as will be explained in greater detail shortly.

Figure 7:
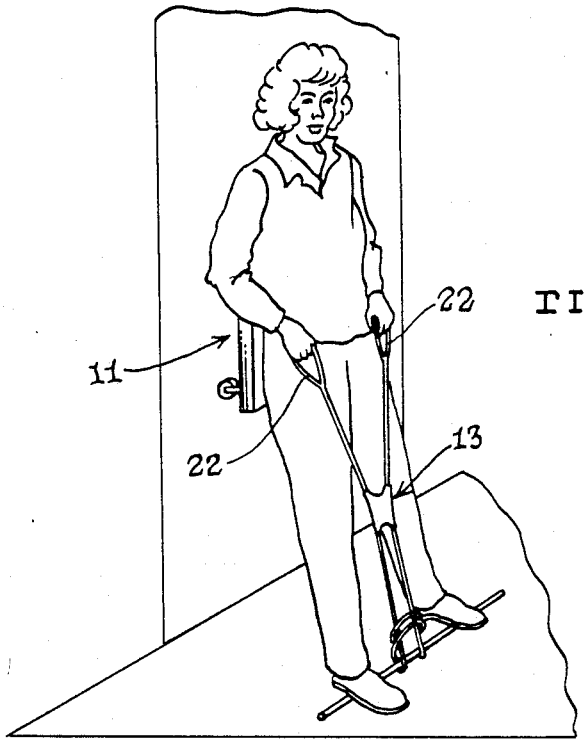
FIGS. 6 and 7 are perspective views of two of the expanded uses of the wheeled platform made possible by the adjunct structure.
Figure 6:
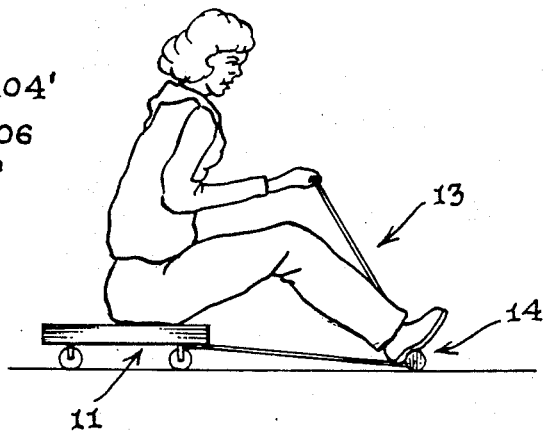

As can be seen by reference to FIG. 6 and 7, the adjunct unit (12) enhances and expands the utilitarian usage of the wheeled unit in both the vertical and horizontal plane. As shown in FIG. 6, the user sits upon the wheeled unit (11) which is disposed in the horizontal plane with one pair of looped handles (22) of the flexible element (13) engaging the forward wheeled elements

(16) of the wheeled unit (11). The intermediate portion of the flexible element (13) passes underneath the elongated bar member (24), and the user grasps the other pair of looped handles (22) on the free end of the flexible element (13).

The user may then employ the combined apparatus (10) as just described as a rowing machine by alternately pulling on the free end of the flexible element (13) to bring the wheeled unit (11) towards the rigid element (14), and then pushing on the rigid element (14) to force the wheeled unit (11) in the opposite direction.

In this particular mode of use, the flexible element (13) slidingly engages the rigid element (14), and the sliding engagement is made possible by the provision of the enlarged cylindrical end caps (25) which space the bar member (24) above the horizontal surface, upon which the wheeled unit is disposed.

Figure 5:
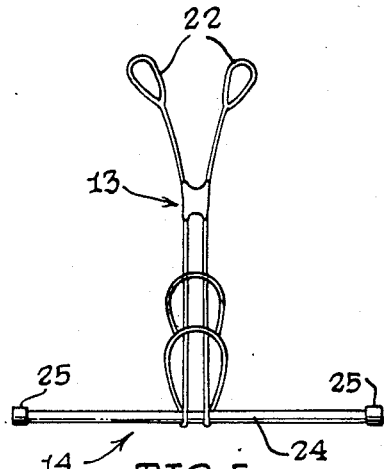
FIG. 5 is a perspective view of the adjunct structure contemplated for use in combination with the wheeled platform.

The combined apparatus (10) is deployed in the vertical plane as follows: The pair of handle loops (22) on one end of the flexible unit (13) are looped around one another, and the bar member (24) of the rigid element (14), as depicted in FIG. 5, to frictionally engage the flexible element (13) to the rigid element (14). The user then positions the wheeled unit (11) against a vertical surface, while standing on the rigid element (14) and grasping the pair of handle loops (22) on the free end of the flexible element (13).

In this mode of use the flexible element (13) is attached to the rigid element (14) in a secure fashion, and the adjunct unit (12) acts as a stabilizing and support means for the user as they vertically reciprocate the wheeled unit (11) against the vertical surface.

Figure 8:
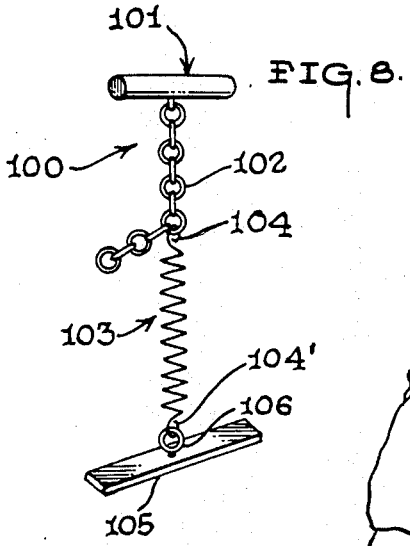
FIG. 8 is an alternate embodiment of the adjunct structure illustrated in FIG. 5.

The alternate embodiment of the adjunct unit (12) is depicted in FIG. 8, and designated generally by the reference numeral (100). This alternate adjunct structure (100) comprises a rigid handle member (101) having a length of linked chain (102) attached to the midpoint of the handle member (101). The alternate adjunct structure (100) further comprises a spring member (103) selectively engageable on one end (104) with the linked chain (102), and attached on its other end (104') to a foot rest member (105) via a swivel element (106).

This particular arrangement allows different height users to quickly adjust the effective length of the alternate adjunct structure (100) by selectively engaging one end (104) of the spring member (103) with a selected one of the links that comprise the linked chain (102).

Having thereby described the subject matter of this invention it should be obvious that many substitutions, modifications, and variations of the combined exercise apparatus are possible in light of the above teachings. It is therefore to be understood that the invention as taught and described herein is only to be limited to the extent of the breadth and scope of the appended claims.

I claim:

1. A combined exercise apparatus equally adapted for use in both the horizontal and vertical planes wherein the combined apparatus consists of:

a wheeled platform unit comprising an elongated generally rectangular padded platform member provided with a plurality of downwardly depending wheeled elements proximate the corners of said platform member, wherein the wheeled elements are aligned for rolling contact with a surface in a direction perpendicular to the long dimension of the elongated generally rectangular padded platform member, and further including means for releasably securing the wheeled platform member to a users torso;

a rigid element comprising an elongated bar member having enlarged cylindrical caps formed on the opposite ends of said bar member; and, an elongated strap comprising an elongated bifurcated double handled strap member wherein each end of the strap member is provided with a pair of handle loops, and the mid-section of the strap member is provided with an intermediate connecting portion, one pair of said handle loops being connectable to one of either said platform or said rigid element; whereby, the use while supported by the wheeled platform member may grasp a pair of handle loops and exert force against said rigid element.

2. The combined apparatus of claim 1; wherein, one of said pair of handle loops on one end of the said strap members engages selected ones of said plurality of wheeled elements on said platform member, and the intermediate portion of the strap member is disposed in sliding engagement with the said rigid element.

3. The combined apparatus of claim 1; wherein, a pair of handle loops on one end of said strap member are looped around one another and the said rigid element.I

* * * * *